US006447379B1

(12) United States Patent
Gromko et al.

(10) Patent No.: US 6,447,379 B1
(45) Date of Patent: Sep. 10, 2002

(54) CARRIER INCLUDING A MULTI-VOLUME DIAPHRAGM FOR POLISHING A SEMICONDUCTOR WAFER AND A METHOD THEREFOR

(75) Inventors: Robert D. Gromko, Phoenix; Stephen C. Schultz, Gilbert; John D. Herb, Phoenix; James F. Lee, Chandler, all of AZ (US); Junedong Lee, Hopewell Junction, NY (US)

(73) Assignee: SpeedFam-IPEC Corporation, Chandler, AZ (US)

( * ) Notice: Subject to any disclaimer, the term of this patent is extended or adjusted under 35 U.S.C. 154(b) by 0 days.

(21) Appl. No.: 09/541,753

(22) Filed: Mar. 31, 2000

(51) Int. Cl.[7] ..... B24B 5/00; B24B 7/04

(52) U.S. Cl. ..... 451/287; 451/288; 451/289; 451/388; 451/390

(58) Field of Search ..... 451/285–288, 451/390, 398

(56) References Cited

U.S. PATENT DOCUMENTS

| | | | | |
|---|---|---|---|---|
| 5,205,082 A | | 4/1993 | Shendon et al. | 51/283 |
| 5,230,184 A | | 7/1993 | Bukham | 51/109 |
| 5,584,746 A | | 12/1996 | Tanaka et al. | 451/41 |
| 5,584,751 A | | 12/1996 | Kobayashi et al. | 451/285 |
| 5,605,488 A | | 2/1997 | Ohashi et al. | 451/7 |
| 5,624,299 A | | 4/1997 | Shendon | 451/285 |
| 5,660,517 A | | 8/1997 | Thomson et al. | 279/3 |
| 5,681,215 A | | 10/1997 | Sherwood et al. | 414/217 |
| 5,738,574 A | | 4/1998 | Tolles et al. | 451/288 |
| 5,762,539 A | | 6/1998 | Nakashiba et al. | 451/41 |
| 5,762,544 A | | 6/1998 | Zuniga et al. | 451/285 |
| 5,762,546 A | | 6/1998 | James et al. | 451/505 |
| 5,795,215 A | | 8/1998 | Guthrie et al. | 451/41 |
| 5,820,448 A | | 10/1998 | Shamouilian et al. | 451/287 |
| 5,964,653 A | * | 10/1999 | Perlov et al. | 451/288 |
| 6,056,632 A | * | 5/2000 | Mitchel et al. | 451/288 |
| 6,106,378 A | * | 8/2000 | Perlov et al. | 451/288 |

* cited by examiner

*Primary Examiner*—M. Rachuba
(74) *Attorney, Agent, or Firm*—James L. Farmer

(57) ABSTRACT

The present invention delineates a carrier for an apparatus (10) which polishes a surface of a semiconductor wafer (56, 124). In a preferred embodiment, the carrier includes a rigid plate (34) connected to one or more diaphragms (40, 42) of soft, flexible material that provide pressurizable cavities (50, 52) having respective surfaces for contacting the back surface of the wafer. A plurality of conduits **(28*a*, 28*c*) are used to selectively pressurize the diaphragm cavities. The carrier head may also include an inter-diaphragm cavity (54) formed between a portion of one diaphragm, a portion of another diaphragm, and the semiconductor wafer. The inter-diaphragm cavity is provided with its own conduit (28*b*) by which a source of pressurized fluid and a source of vacuum are selectively connected to the inter-diaphragm cavity. During operation, pressure and/or vacuum may be applied through one or more cavities to chuck (90) a wafer, and to pressurize (96)** the cavities during polishing.

10 Claims, 6 Drawing Sheets

CARRIER INCLUDING A MULTI-VOLUME DIAPHRAGM FOR POLISHING A SEMICONDUCTOR WAFER AND A METHOD THEREFOR

BACKGROUND OF THE INVENTION

The present invention relates to semiconductor processing equipment, and more particularly to carriers for holding a semiconductor wafer during chemical-mechanical planarization.

Semiconductor wafers are planarized or polished to achieve a smooth, flat finish before performing process steps that create electrical circuits on the wafer. This polishing is accomplished by securing the wafer to a carrier, rotating the carrier and placing a rotating polishing pad in contact with the rotating wafer. The art is replete with various types of wafer carriers for use during this polishing operation. A common type of carrier is securely attached to a shaft which is rotated by a motor. A wet polishing slurry, usually comprising a polishing abrasive suspended in a liquid, is applied to the polishing pad. A downward polishing pressure is applied between the rotating wafer and the rotating polishing pad during the polishing operation. This system required that the wafer carrier and polishing pad be aligned perfectly parallel in order to properly polish the semiconductor wafer surface.

The wafer carrier typically was a hard, flat plate which did not conform to the surface of the wafer which is opposite to the surface being polished. As a consequence, the carrier plate was not capable of applying a uniform polish pressure across the entire area of the wafer, especially at the edge of the wafer. In an attempt to overcome this problem, the hard carrier plate often was covered by a softer carrier film. The purpose of the film was to transmit uniform pressure to the back surface of the wafer to aid in uniform polishing. In addition to compensating for surface irregularities between the carrier plate and the back wafer surface, the film also was supposed to smooth over minor contaminants on the wafer surface. Such contaminants could produce high pressure areas in the absence of such a carrier film. Unfortunately, the films were only partially effective with limited flexibility and tended to take a "set" after repeated usage. In particular, the set appeared to be worse at the edges of the semiconductor wafer.

The wafer carrier described in U.S. Pat. No. 5,762,544 typifies another problem associated with many prior wafer carrier designs. U.S. Pat. No. 5,762,544 discloses use of a flat, rigid carrier base that was connected to a shaft through a gimballing mechanism intended to keep the carrier base surface parallel to the semiconductor wafer surface during polishing. Typically, the arrangement resulted in applying one pressure across the entire semiconductor wafer surface. Thus, changing the force transferred through the shaft to the carrier base resulted in altering the applied pressure across the entire surface of the semiconductor wafer. The problem with using wafer carriers like the one described in U.S. Pat. No. 5,762,544 is that despite the apparent application of uniform pressure over the wafer surface, some planarization methods form one or more annular depressions near the perimeter of the wafer on the surface upon which circuit deposition is to occur. Only sufficiently smooth, flat portions of the wafer surface can be effectively used for circuit deposition. Thus, the annular depressions limit the useful area of the semiconductor wafer.

Other wafer carrier designs, such as described in U.S. Pat. No. 5,762,539, implement means for applying more than one pressure region across the back surface of the semiconductor wafer to attempt to compensate for uneven removal patterns, such as the annular depressions noted above. Specifically, the carrier described in U.S. Pat. No. 5,762,539 provides a top plate with a plurality of internal chambers that may be independently pressurized. A plurality of holes penetrate the top plate and a pad abutting the bottom surface of the top plate. By pressurizing the individual chambers in the top plate to different magnitudes, different pressure distributions can be established across the wafer surface abutting the pad; however, the pressure distributions are not sufficiently controllable to establish distinct areas across the back surface of the wafer having the same applied pressure. This is because pressurized fluid is directly applied to the back surface of the wafer through the tiny holes in the top plate, and the pressurized fluid is substantially free to move across the wafer's back surface. Thus, pressurized fluid applied to one area of the back surface of the wafer moves into adjacent areas of the wafer's back surface being supplied with a pressurized fluid at a different pressure. Therefore, the ability to control the applied pressure across specified, distinct sections of the wafer is limited, thereby restricting the ability of the design to compensate for anticipated removal problems.

There therefore was a need to provide a carrier design permitting controlled application of multiple pressure regions across the back surface of a semiconductor wafer during polishing.

BRIEF SUMMARY OF THE INVENTION

A general object of the present invention is to provide an improved wafer carrier for polishing semiconductor wafers.

Another object is to provide a wafer carrier which applies uniform pressure over the entire area of the semiconductor wafer, if desired.

Yet another object of the present invention is to provide a wafer carrier which applies non-uniform, yet controlled pressure over the entire area of the semiconductor wafer to compensate for anticipated, troublesome removal patterns such as a perimeter annular depression or a centrally located bulge typically referred to as a center slow problem.

A further object of the present invention is to provide a surface on the carrier which contacts the back surface of the semiconductor wafer and conforms to any irregularities of that back surface. Preferably, the surface of the carrier should conform to even minute irregularities in the back surface of the semiconductor wafer.

These and other objectives are satisfied by a carrier for an apparatus which performs chemical-mechanical planarization of a surface of a workpiece that includes a rigid plate having a major surface. The carrier also includes a first diaphragm of soft, flexible material with a first section for contacting a first surface portion of the workpiece. The first diaphragm is connected to the rigid plate and extends across at least a first portion of the major surface, thereby defining a first cavity therebetween.

The carrier also includes a second diaphragm of soft, flexible material with a second section for contacting a second surface portion of the workpiece. The second diaphragm is also connected to the rigid plate and extends across at least a second portion of the major surface, thereby defining a second cavity therebetween. A plurality of fluid conduits provides pressurized fluid, such as a gas, that is connected to one or more of the cavities.

By pressurizing the cavities to the same or to different pressures, as desired, one can apply a uniform or a controlled, non-uniform pressure distribution over the workpiece surface, respectively. Additionally, since the diaphragms are made from a soft, flexible material, such as polyurethane, or nitrile rubber, or butyl rubber, the diaphragms, which contact the back surface of the workpiece, conform to any irregularities of that back surface.

In the preferred apparatus embodiment of the present invention, only two diaphragms having associated cavities and an inter-diaphragm cavity are included; however, in general, any desired number of diaphragms with their respective cavities and inter-diaphragm cavities may be implemented. Additionally, regardless of the selected number of diaphragms, they may be separate diaphragms connected together or one integral diaphragm having the desired number of independent cavities.

In another embodiment of the present invention, the carrier comprises a rigid plate having a major surface with a plurality of cavities formed therein, a diaphragm of flexible material coupled to and abutting a portion of the major surface, a first member coupled to and abutting a lower surface of the diaphragm, a second member coupled to and abutting the lower surface of the diaphragm, and a plurality of fluid conduits by which a source of pressurized fluid, such as a gas, is connected to at least one of the cavities. As in the prior embodiment of the carrier, appropriate pressurization of the carrier cavities in this later embodiment can compensate for otherwise uneven removal rates during polishing of the workpiece.

The present invention also provides a method for controlling the chemical-mechanical planarization of a surface of a workpiece to compensate for uneven removal rates on the surface comprising: providing a rigid plate having a major surface; pressurizing a first cavity formed by a first diaphragm of soft, flexible material and by a first portion of the major surface of the rigid plate to permit a first section of the first diaphragm to contact a first surface portion of the workpiece which is located on a side that is opposite the surface of the workpiece; pressurizing a second cavity formed by a second diaphragm of soft, flexible material and by a second portion of the major surface of the rigid plate to permit a second section of the second diaphragm to contact a second surface portion of the workpiece which is located on a side that is opposite the surface of the workpiece; selecting pressurization of the cavities to compensate for the uneven removal rates; and polishing the surface of the workpiece.

During polishing, the cavities are pressurized with fluid, such as a gas, which causes the diaphragms to exert force against the workpiece pushing the workpiece into an adjacent polishing pad. Because the diaphragms are made from a thin, soft, and highly flexible material, the diaphragms conform to the back surface of the workpiece which is opposite to the surface to be polished. By conforming to even minute variations in the workpiece surface, the diaphragms exert pressure evenly over the entire back surface of the workpiece, thereby producing uniform polishing.

These and other objects, advantages and aspects of the invention will become apparent from the following description. In the description, reference is made to the accompanying drawings which form a part hereof, and in which there is shown a preferred embodiment of the invention. Such embodiment does not necessarily represent the full scope of the invention and reference is made therefor, to the claims herein for interpreting the scope of the invention.

DETAILED DESCRIPTION OF THE INVENTION

Figure 1:
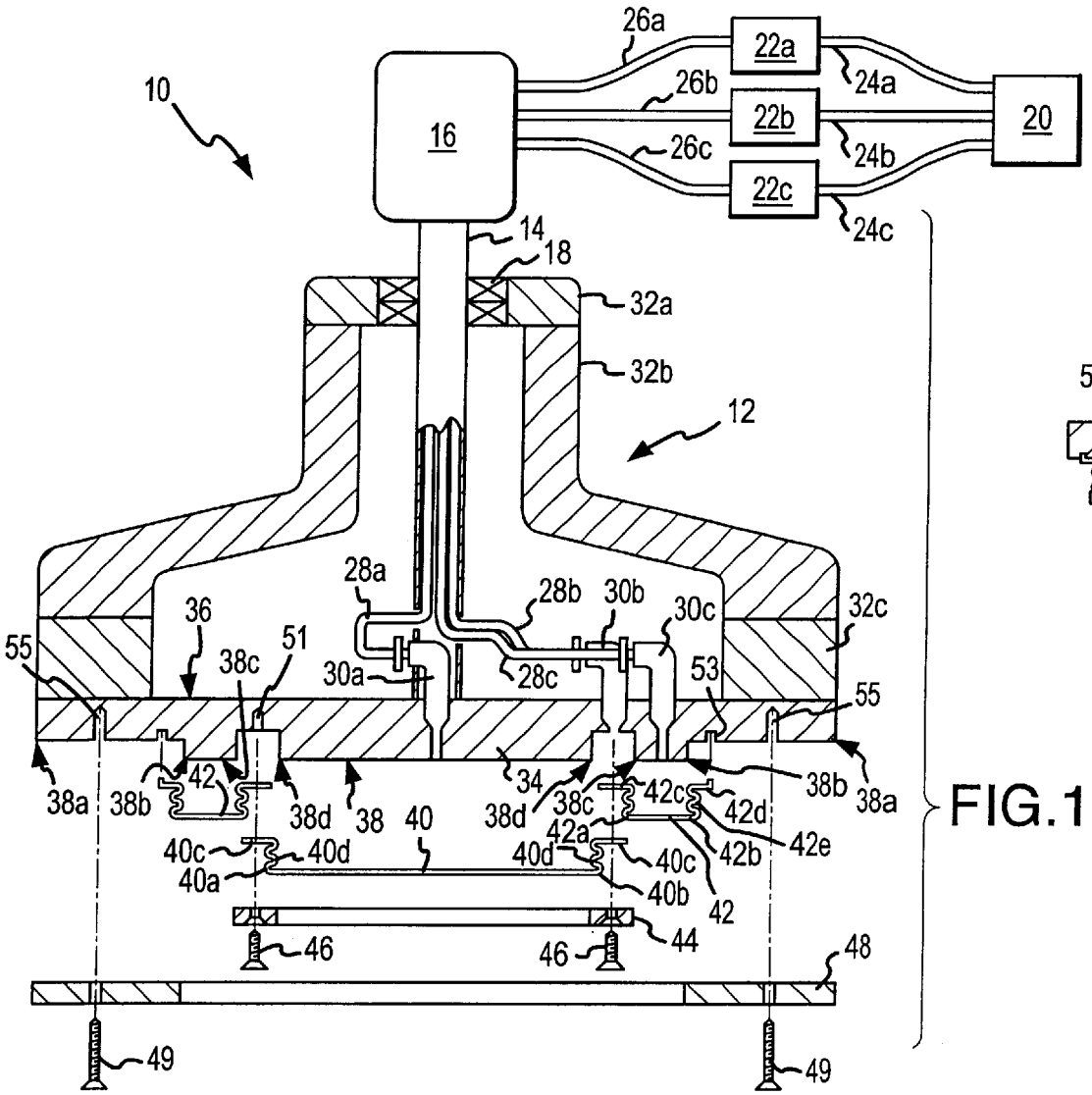
FIG. 1 is a diametric, cross-sectional, exploded view of a polishing apparatus in accordance with a preferred embodiment of the present invention.

Referring now to the drawings, wherein like reference characters represent corresponding elements throughout the several views, and more specifically referring to FIG. 1, a diametric, cross-sectional, exploded view of a polishing apparatus 10 is shown in accordance with a preferred embodiment of the present invention. In the preferred embodiment, apparatus 10 is used to planarize or polish a front surface of a semiconductor wafer; however, apparatus 10 may be used to polish a "workpiece" which is generally defined to include: semiconductor wafers, both bare silicon or other semiconductor substrates such as those with or without active devices or circuitry, and partially processed wafers, as well as silicon on insulator, hybrid assemblies, flat panel displays, Micro Electro-Mechanical Sensors (MEMS), MEMS wafers, hard computer disks or other materials that would benefit from planarization.

Apparatus 10 has a carrier 12 mounted on a spindle shaft 14 that is connected to a rotational drive mechanism by a gimbal assembly (not shown). One end of spindle shaft 14 is connected to a rotating coupling 16. Rotating coupling 16 is of a type well known to those skilled in the art, such as the rotary coupling manufactured under Rotary Systems Part No. 202196. Rotating coupling 16 permits the transfer of pressurized fluid, such as a gas, through multiple conduits that are fixed on the supply side of rotating coupling 16, yet moving on the carrier side of rotating coupling 16. Specifically, tubing 26*a,* 26*b,* and 26*c* is stationary. Element 20 represents a source for providing pressurized fluid (e.g., gas) or vacuum. Elements 22*a,* 22*b,* and 22*c* represent regulators that control either the degree of pressurization of the fluid (e.g., gas) or the magnitude of supplied vacuum. Pressure and vacuum regulators, such as those manufactured by SMC Pneumatics, Inc. under Part No. IT2011-N32, are well known to those skilled in the art.

Tubing 24*a,* 24*b,* and 24*c* is provided between the combination pressurization/vacuum source and the respective regulators 22*a,* 22*b,* and 22*c* that are connected to the rotating coupling 16 through tubing 26*a,* 26*b,* and 26*c.* Tubing 26*a,* 26*b,* and 26*c* is respectively connected to tubing 28*a,* 28*b,* and 28*c* through rotating coupling 16. Tubing 28*a,* 28*b,* and 28*c* is shown within an internal cavity of spindle shaft 14; however, tubing 28*a,* 28*b,* and 28*c* need not reside within spindle shaft 14. Tubing 28*a,* 28*b,* and 28*c* is respectively connected to tubing fittings 30*a,* 30*b,* and 30*c.* Tubing fittings 30*a,* 30*b,* and 30*c* penetrate an upper surface 36 of rigid plate 34 and permit fluid communication through to a lower surface 38 of rigid plate 34, thereby establishing fluid communication from the combination pressurization/vacuum source 20 all the way through to the lower surface 38 of rigid plate 34. Tubing 24*a*–24*c,* 26*a*–26*c,* and 28*a*–28*c* is preferably flexible and lightweight, though tubing materials of various different flexibilities and weights may be employed. Such tubing is well known to those skilled in the art. Additionally, any one of a variety of different types of tubing fittings well known to those skilled in the art may be used for tubing fittings 30*a*–30*c.*

Thus, a plurality of conduits run from the combination pressurization/vacuum source 20 to the major or lower surface 38 of rigid plate 34, and the conduits provide a source of "pressurized" fluids or gasses to cavities (discussed below). However, the term, "pressurized," is intended to refer to absolute pressure. Thus, a positive absolute pressure means the fluid, such as a gas, within the conduits is pressurized, and an absolute pressure of zero means vacuum is supplied through the conduits.

Spindle shaft 14 preferably comprises a sturdy, rigid material such as stainless steel; however, any sturdy, rigid, and preferably lightweight material may be used for spindle shaft 14. Spindle shaft 14 is coupled at one end to rotating coupling 16, and is connected at an opposite end to rigid plate 34. Spindle shaft 14 is also supported with journal bearing 18. The detailed connection of spindle shaft 14 to rigid plate 34 is not shown, as any one of a number of different types of connection may be implemented. A cover is provided comprising an upper section 32*a,* a middle section 32*b,* and a lower section 32*c.* The cover 32*a*–32*c* is connected over rigid plate 34 in order to protect spindle shaft 14, tubing 28*a*–28*c,* and tubing fittings 30*a*–30*c* from debris. Cover 32*a*–32*c* is preferably made from a lightweight material, and may be connected to rigid plate 34 in any one of a number of different manners well known to those skilled in the art.

Focusing on the lower surface 38 of rigid plate 34, as viewed from left to right in FIG. 1, lower surface 38 includes an annular recess between positions 38*a,* and 38*b,* a raised annular portion between positions 38*b* and 38*c,* another annular recess between positions 38*c* and 38*d,* and a raised cylindrical portion bounded by position 38*d.* Rigid plate 34 is preferably made of stainless steel, although any sturdy, rigid material may be substituted if desired. A diaphragm 40 is coupled to the rigid plate 34. Diaphragm 40 includes a centrally disposed section between positions 40*a* and 40*b* for contacting a surface portion of an upper surface of a workpiece (e.g., a semiconductor wafer 56, FIG. 2). The contact section of diaphragm 40 is substantially circular. Diaphragm 40 also includes a rim 40*c* facilitating connection with rigid plate 34, and a bellows 40*d* located between the rim 40*c* and the wafer contact section bounded by positions 40*a* and 40*b.*

Another diaphragm 42 also includes a section for contacting a surface portion of upper surface 56*u* of semiconductor wafer 56. The wafer contact section for diaphragm 42 comprises an annular area bounded by positions 42*a* and 42*b*. Diaphragm 42 includes an inner rim 42*c* and an outer rim 42*d* facilitating connection with rigid plate 34. Diaphragm 42 also includes a bellows 42*e* between the diaphragm's wafer contact section and rims 42*c* and 42*d*. Both diaphragms 40 and 42 are preferably made of a soft, flexible material, such as polyurethane; however, any soft, flexible and substantially thin material may be used for diaphragms 40 and 42.

An annular clamp 44 is fastened to rigid plate 34 using fasteners 46 (e.g., screws or other connectors) and corresponding threaded cavities 51, thereby securely fastening rims 40*c* and 42*c* against the lower surface 38 of rigid plate 34. Similarly, wear ring 48 is fastened against the lower surface 38 of rigid plate 34 using fasteners 49 and threaded cavities 55. When fastened to rigid plate 34, wear ring 48 clamps outer rim 42*d* of diaphragm 42 against lower surface 38 of rigid plate 34. A protruding rib in outer rim 42*d* is inserted into a notch 53 located in lower surface 38 of rigid plate 34 to facilitate proper positioning of diaphragm 42. As such, the wear ring 48 clamps outer rim 42*d* against lower surface 38.

Figure 2:
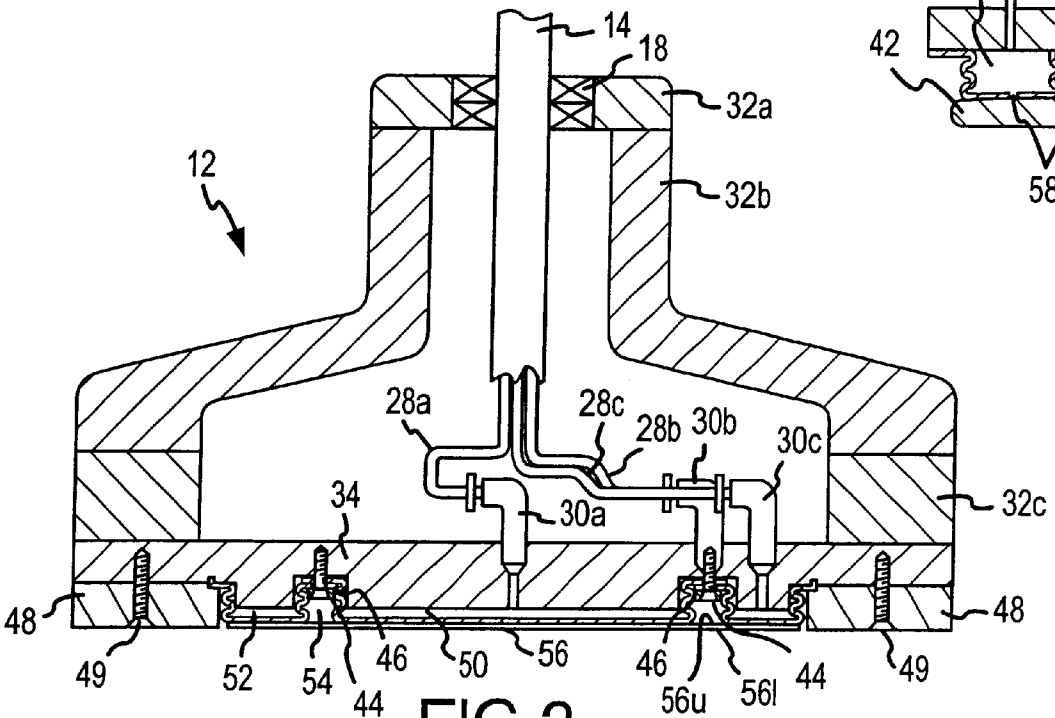
FIG. 2 is a diametric, cross-sectional, fully-assembled view of the polishing apparatus from FIG. 1 in accordance with a preferred embodiment of the present invention.

FIG. 2 is a diametric, cross-sectional, fully-assembled view of the polishing apparatus from FIG. 1 in accordance with a preferred embodiment of the present invention. FIG. 2 shows the polishing apparatus in contact with the back or upper surface 56*u* of a workpiece 56 (e.g., a semiconductor wafer). Workpiece 56 also has a front or lower surface 56*l* which is polished when placed in contact with a polishing pad (not shown).

A cavity 50 is formed between diaphragm 40 and lower surface 38 of rigid plate 34. Similarly, a cavity 52 is formed between diaphragm 42 and lower surface 38 of rigid plate 34. Additionally, a cavity 54 is formed between a portion of diaphragm 40, a portion of diaphragm 42, and a portion of the semiconductor wafer 56. Cavity 54 is referred to as the "inter-diaphragm cavity." Cavity 50 is generally cylindrical in shape, while cavities 52 and 54 are generally annular in shape and are concentrically located with respect to cavity 50.

Figure 3:
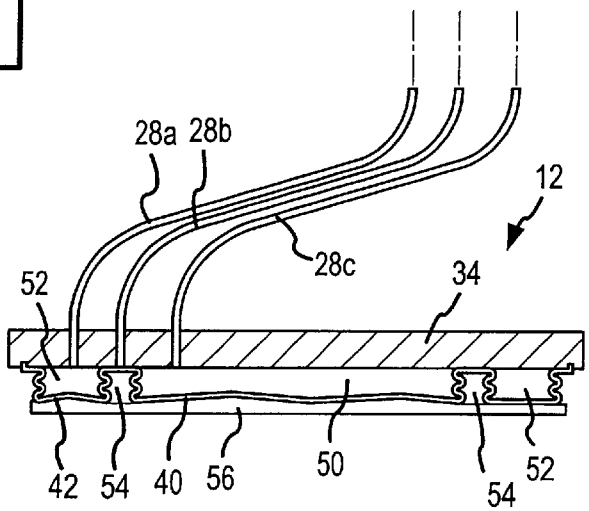
FIG. 3 is a diametric cross-sectional view of a portion of the carrier from FIG. 1 in accordance with a preferred embodiment of the present invention.

Referring to FIG. 3, a diametric cross-sectional view of a portion of carrier 12 is shown in accordance with a preferred embodiment of the present invention. The carrier portion is shown with diaphragm sections conformably engaged with the upper surface of a semiconductor wafer 56. Tubing or conduits 28*a,* 28*b,* and 28*c* provide pressurized fluid (e.g., gas) or vacuum through rigid plate 34 to their respective cavities 52, 54, and 50. Diaphragm 40 and rigid plate 34 form cavity 50, while diaphragm 42 and rigid plate 34 form cavity 52. Inter-diaphragm cavity 54 is formed by portions of diaphragm 40 and 42, as well as a portion of semiconductor wafer 56. In this version of inter-diaphragm cavity 54, the side boundaries of cavity 54 are formed by portions of diaphragms 40 and 42, while the upper boundary of cavity 54 is formed by rigid plate 34, and the lower boundary is formed by semiconductor wafer 56. In this regard, substantially no portion of the lower boundary of inter-diaphragm cavity 54 is provided by diaphragms 40 and 42. The contact sections of diaphragms 40 and 42 are slightly bent or angled due to their conforming to minute variations in the upper surface 56*u* (FIG. 2) of semiconductor wafer 56.

Figure 4:
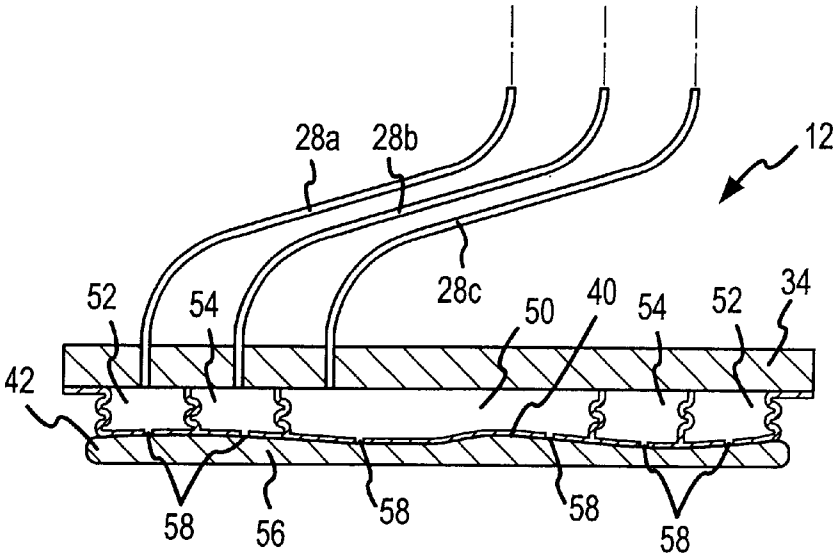
FIG. 4 is a diametric cross-sectional view of a portion of the carrier from FIG. 1 in accordance with an alternate embodiment of the present invention.

Referring to FIG. 4, a diametric cross-sectional view of a portion of carrier 12 is shown in accordance with an alternate embodiment of the present invention. The portion of carrier 12 is shown with diaphragm sections conformably engaged with the upper surface of a semiconductor wafer 56. The version of carrier 12 shown in FIG. 4 is substantially similar to that shown in FIG. 3. One difference between these two versions of carrier 12 is that the lower boundary of inter-diaphragm cavity 54 is partially formed by diaphragms 40 and 42. In FIG. 3, the lower boundary of the inter-diaphragm cavity 54 is exclusively formed by the semiconductor wafer 56.

Another difference depicted in the carrier 12 of FIG. 4 is that diaphragms 40 and 42 include one or more apertures 58 through their respective contact sections. One or more apertures 58 may be located in one or more of the contact sections corresponding to cavities 50, 52, and 54. As described in more detail in conjunction with FIG. 7, apertures 58 enable chucking of the semiconductor wafer prior to polishing. Although apertures 58 are shown in each of cavities 50, 52, and 54 in FIG. 4, it is not necessary that apertures 58 are present in each cavity.

Figure 5:
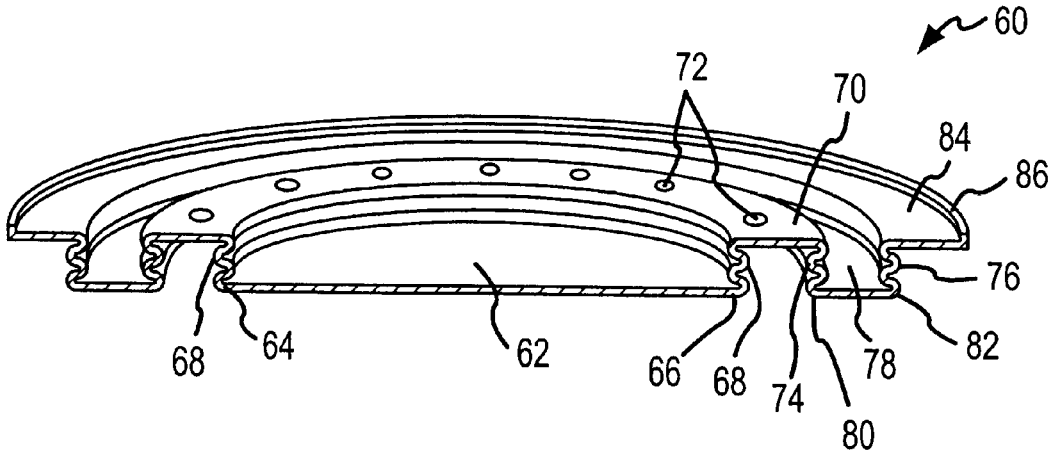
FIG. 5 is a perspective view of a portion of a unitary diaphragm in accordance with an alternate embodiment of the present invention.

Referring to FIG. 5, a perspective view of a portion of a unitary diaphragm 60 is shown in accordance with an alternate embodiment of the present invention. As shown, diaphragm 60 provides a plurality of cavities when connected to the carrier's rigid plate.

Diaphragm 60 is substantially identical to diaphragms 40 and 42 from FIGS. 1 and 2, when diaphragms 40 and 42 are taken in combination. In other words, the only difference between diaphragms 40 and 42, and diaphragm 60 is that diaphragm 60 comprises a single, integral diaphragm. Therefore, diaphragm 60 could be used in lieu of diaphragms 40 and 42 in carrier 12 as shown in FIGS. 1–4.

Diaphragm 60 includes a central, circular-shaped contact section 62 bounded by positions 64 and 66. A bellows portion 68 extends up from central contact section 62. An annular connecting section 70 includes apertures 72 used in fastening diaphragm 60 to rigid plate 34 (FIG. 1). The majority of apertures 72 are used to fasten diaphragm 60 to rigid plate 34; however, at least one of the apertures 72 is used to pressurize the inter-diaphragm cavity 54 (FIG. 2) formed between bellows portions 68 and 74. An annular contact section 78 is bounded by positions 80 and 82. Another bellows portion 76 extends upwardly from annular contact section 78. An annular rim 84 and protruding rib portion 86 are used to align and securely fasten diaphragm 60 between wear ring 48 (FIG. 1) and rigid plate 34. Cavity 50 (FIG. 2) is formed between bellows 68, central contact section 62, and rigid plate 34. The inter-diaphragm cavity 54 (FIG. 2) is formed between bellows portion 68, bellows portion 74, annular connecting section 70, and wafer 56 (FIG. 2). Cavity 52 (FIG. 2) is formed between annular contact section 78, bellows portions 74 and 76, and rigid plate 34.

Figure 6:
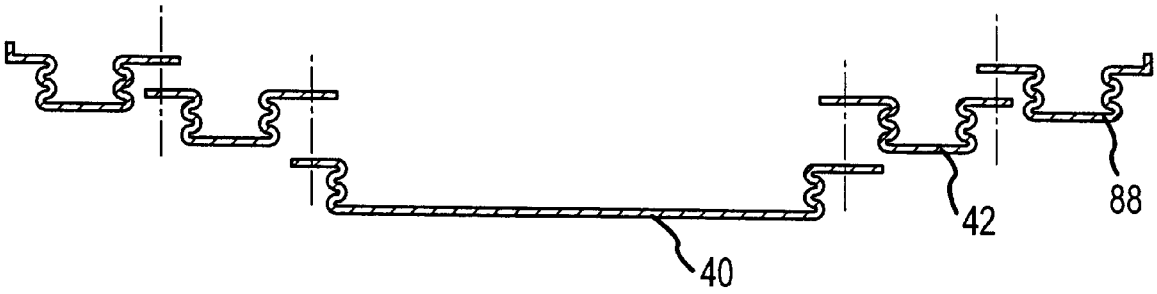
FIG. 6 is a simplified, cross-sectional view of a plurality of diaphragms that may be coupled together with the carrier in accordance with another alternate embodiment of the present invention.

FIG. 6 shows a simplified, cross-sectional view of a plurality of diaphragms that may be coupled together with the carrier in accordance with another alternate embodiment of the present invention. The distinct diaphragm sections 40, 42, and 88, may be coupled together in a manner analogous to that described in conjunction with FIGS. 1 and 2.

As described previously, the coupling of diaphragm sections 40 and 42 shown in FIGS. 1 and 2 resulted in formation of three cavities 50, 52, and 54 which could be individually pressurized. FIG. 6 illustrates that at least one additional diaphragm section 88 could also be employed, which would result in formation of two additional cavities (not shown). These additional cavities also could be individually pressurized. Thus, where the diaphragm sections 40 and 42 of FIGS. 1 and 2 enable precise control of the pressures applied to the center region and one annular region of the semiconductor wafer, the additional diaphragm section 88 enables the pressure applied to a second annular region of the wafer to be more precisely controlled. This precise control during the polishing process could yield an even more flat wafer surface than is achievable using embodiments which include two or fewer diaphragm sections. In other alternate embodiments, even more diaphragm sections could be employed.

Figure 7:
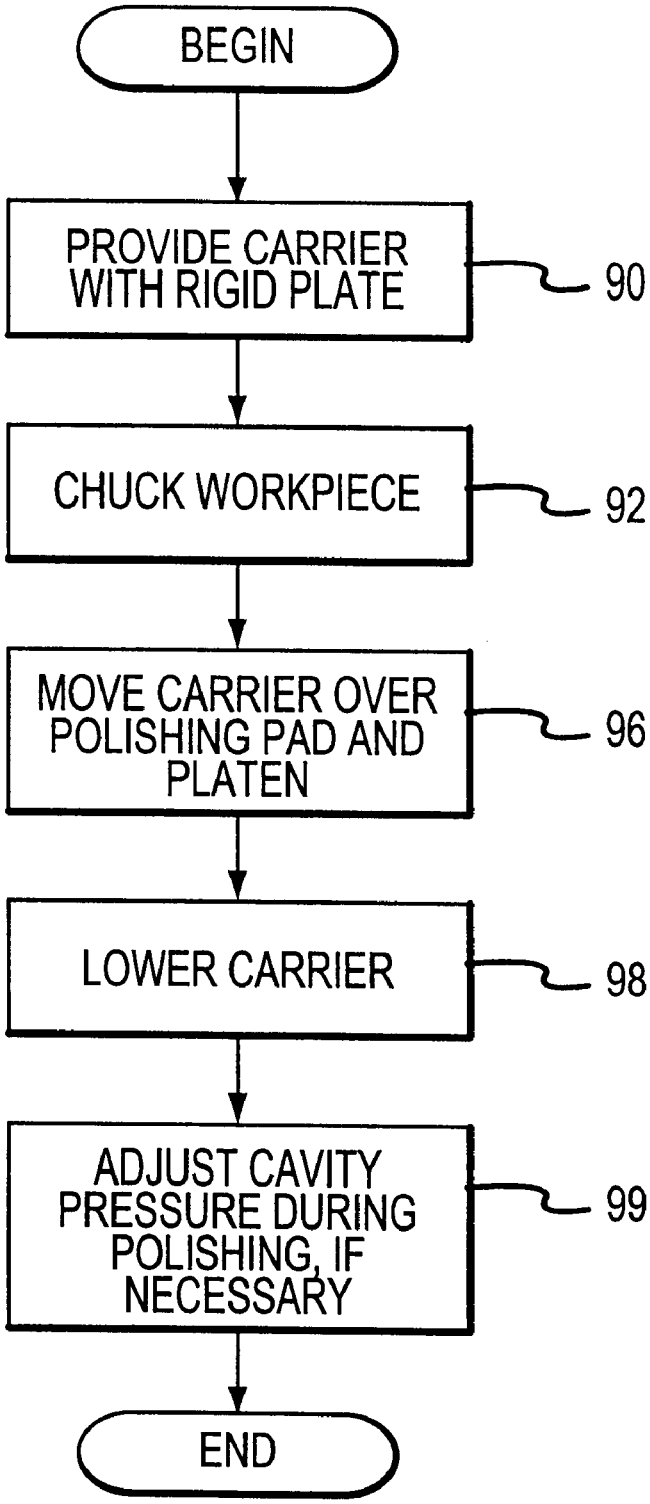
FIG. 7 is a flowchart of a method for operating the carrier in order to polish a workpiece in accordance with a preferred embodiment of the present invention.

FIG. 7 illustrates a flowchart of a method for operating the carrier in order to polish a workpiece in accordance with a preferred embodiment of the present invention. The method begins, in step 90, by providing a carrier which includes a rigid plate as described herein. In step 92, the semiconductor wafer or other workpiece to be polished is chucked. This is achieved by suspending carrier 12 over one or more semiconductor wafers 56 to be processed. Carrier 12 is lowered to a position slightly above the top wafer 56.

If no apertures 58 (FIG. 4) are provided in diaphragms 40 and 42, the inter diaphragm diaphragm cavity 54 (FIG. 2) is used to chuck the wafer. Accordingly, the conduit linked to inter-diaphragm cavity 54 is connected to a vacuum source, while the conduits associated with cavities 50 and 52 (FIG. 2) are initially pressurized, if desired, to help establish a seal against semiconductor wafer 56 in order to have it chucked against diaphragms 40 and 42. Alternatively, one or more apertures 58 (FIG. 4) may be included through the contact sections for diaphragms 40 and/or 42. In this latter case, any one or more of the cavities 50, 52, and 54, may be evacuated to chuck the semiconductor wafer 56.

Next in step 96, the carrier 12 and wafer 56 are moved over a polishing pad and platen (not shown) and then lowered, in step 98, such that the lower surface **56*l* (FIG. 2) of wafer 56** makes contact with the polishing pad. From this point, any polishing technique well known to those skilled in the art may be used, such as rotational, orbital, or a combination thereof.

Regardless of the polishing technique used, in step 99, the user may adjust the pressure in cavities 50–54 to the same pressure in an effort to establish uniform polishing pressure across the entire surface of semiconductor wafer 56. Alternatively, the user may adjust the pressure in cavities 50–54 (FIG. 2) to different levels, thereby establishing a non-uniform, yet controlled force distribution across the entire surface of the semiconductor wafer 56.

In this manner, a user can increase the force distribution across an area which would otherwise experience slow removal rates if a uniform force distribution was implemented across the surface of the semiconductor wafer 56. For example, one problem experienced in the industry is referred to as a "center slow removal rate." A center slow removal rate of a polished semiconductor wafer 56 is exemplified by a central portion of the semiconductor wafer 56 having a hemispherical or dome-like bulge.

It would be advantageous to apply a greater force distribution across the central portion of the semiconductor wafer 56 in order to avoid the center slow problem. In this instance, the user would apply a relatively higher pressure to cavity 50 than to cavities 52 and 54 in order to establish a greater force distribution across the central portion of semiconductor wafer 56. The greater force distribution across the central portion of semiconductor wafer 56 equates to a higher removal rate in this region of the semiconductor wafer 56. Thus, a smoother, flat finish may be established on the lower or working surface **56*l* (FIG. 2) of semiconductor wafer 56**.

After polishing has been completed, the method ends. The method could be applied to each of the embodiments shown in FIGS. 1–6, and, with a few modifications, also to the embodiments shown in FIGS. 8–10, described below. Depending on the embodiment, a different number of cavities may need to be pressurized in order to best achieve the advantages of the present invention.

Figure 8:
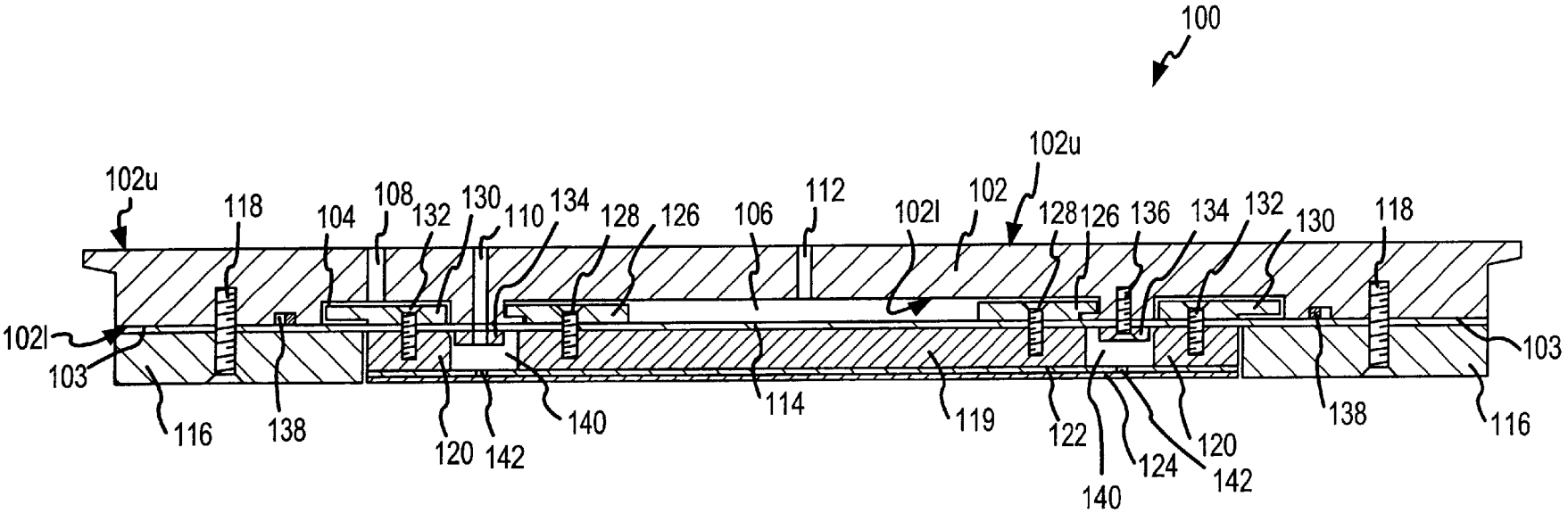
FIG. 8 is a diametric, cross-sectional, fully-assembled view of the carrier in accordance with another alternate embodiment of the present invention.
Figure 9:
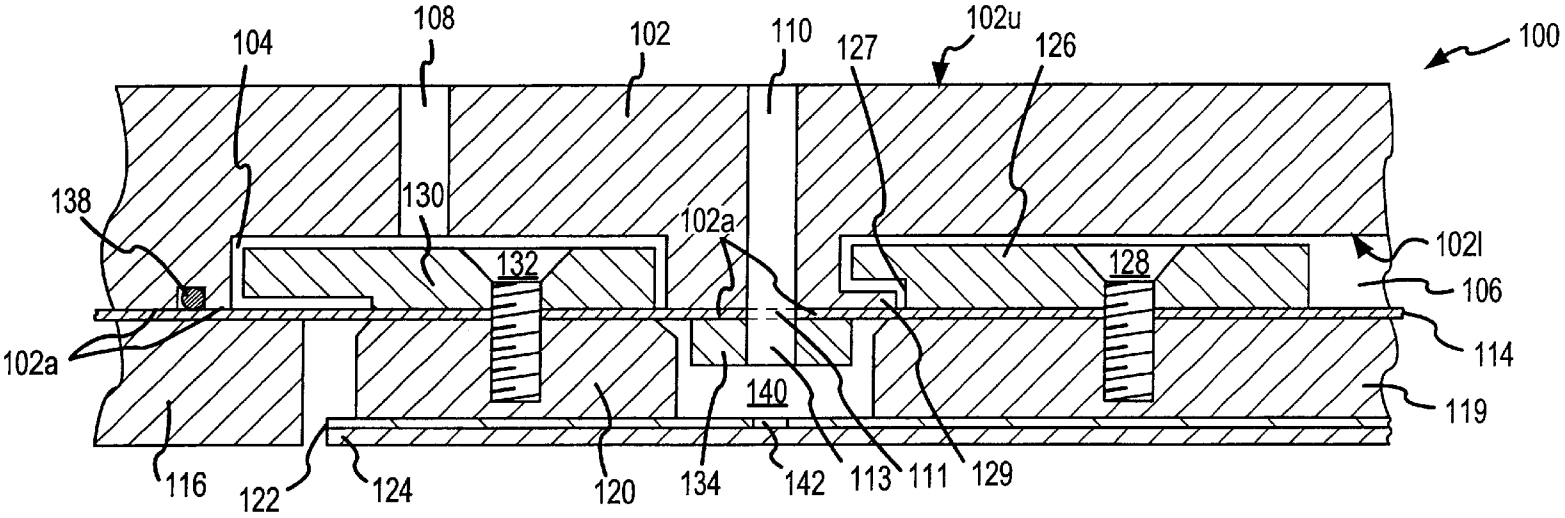
FIG. 9 is diametric cross-sectional view of a portion of the carrier from FIG. 8.
Figure 10:
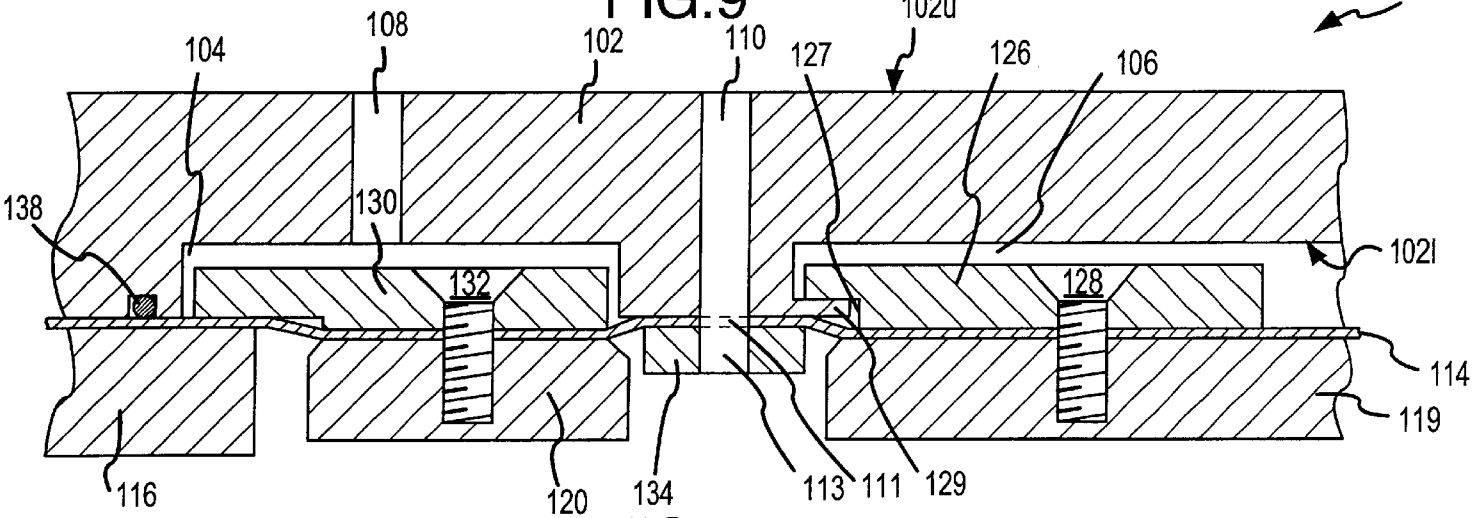
FIG. 10 is another diametric cross-sectional view of a portion of the carrier from FIG. 8.

FIG. 8 is a diametric, cross-sectional, fully-assembled view of the carrier 100 in accordance with another alternate embodiment of the present invention. FIGS. 9 and 10 are diametric cross-sectional views of a portion of the carrier from FIG. 8.

Like carrier 12 shown in FIGS. 1–4, carrier 100 is part of an apparatus for performing chemical-mechanical planarization of a front surface of a workpiece, such as a semiconductor wafer. Thus, while carrier 100 is not shown as part of a larger planarization apparatus, it is understood that carrier 100 is preferably coupled to the various elements comprising a planarization apparatus (e.g., the spindle shaft 14, rotating coupling 16, etc. of FIGS. 1–2).

Carrier 100 includes a rigid plate 102 having upper 102*u* and lower 102*l* surfaces. Focusing on the lower surface 102*l* of rigid plate 102, as viewed from left to right in FIG. 8, lower or major surface 102*l* includes a generally flat outer annular area 103, and a plurality of cavities 138, 104, and 106 formed in lower surface 102*l*.

In a preferred embodiment, the relatively small annular cavity 138 retains an O-ring. In other embodiments, annular cavity 138 would not be included. Continuing to move toward the right, a larger annular cavity 104 is formed in lower surface 102*l*, and a cylindrical cavity 106 is concentrically located with respect to annular cavity 104. The rigid plate 102 is preferably made of stainless steel, though any suitably strong, rigid material may be implemented.

A plurality of fluid conduits 108, 110, and 112 pass through rigid member 102. Fluid conduits 108, 110, and 112 are coupled to independent pressurization sources (not shown) that can supply either vacuum or fluid (e.g., gas) at a selected pressure to any one of the conduits 108, 110, and 112. In a preferred embodiment, the vacuum or fluid (e.g., gas) are supplied in a manner similar to that described in conjunction with FIGS. 1–2. Fluid conduits 108 and 112 are in communication with their respective cavities 104 and 106, while fluid conduit 110 is in communication with intermediate cavity 140 (to be discussed below).

As more easily viewed in FIG. 9, a diaphragm 114 of flexible material is coupled to and abuts certain portions 102*a* of the lower surface 102*l* of plate 102.

Diaphragm 114 preferably comprises a round piece of suitably flexible, resilient material (e.g., neoprene).

Referring back to FIG. 8, wear ring 116 clamps an upper surface of diaphragm 114 against the portions 102*a* of the lower surface 102*l* of plate 102 using fasteners 118 (e.g., screws or other connectors) which pass through apertures (not shown) in diaphragm 114. Wear ring 116 preferably comprises a ceramic type or plastic material well known to those skilled in the art.

A cylindrical member 119 is coupled to a lower surface of diaphragm 114 using annular clamp 126 and connectors 128, which also pass through apertures (not shown) in diaphragm 114. As shown more clearly in FIG. 9, annular clamp 126 includes a notch 127 located above diaphragm 114 to facilitate a retaining lip 129 of rigid plate 102.

cylindrical member 119 is located below cavity 106, and centered with respect to rigid plate 102 and semiconductor wafer 124. Cylindrical member 119 and annular clamp 126 are preferably made of stainless steel, though any rigid material may be implemented.

An annular member 120 is also coupled to the lower surface of diaphragm 114 using annular clamp 130 and fasteners 132 (e.g., screws or other connectors) which pass through apertures (not shown) in diaphragm 114. Annular clamp 130 fits within cavity 104, though it does not completely occupy the cavity volume as evident in FIG. 9. Annular member 120 is concentrically located with respect to cylindrical member 119. Moreover, annular member 120 is located below cavity 104 and above a peripheral annular area of semiconductor wafer 124. Annular member 120 and annular clamp 130 are also preferably made of stainless steel, though any rigid material may be implemented.

The lower surfaces of members 119 and 120 essentially provide pressure directly to a center portion and an annular portion of the back surface of semiconductor wafer 124, although a relatively thin carrier film 122 (described below) is disposed between the lower surfaces of members 119, 120 and the back surface of semiconductor wafer 124. Therefore, the lower surfaces of members 119 and 120 are desirably as flat and smooth as possible in order to ensure that even pressures will be applied to the wafer 124 across members 119 and 120.

As is easily viewed in FIG. 9, an intermediate cavity 140 is formed between cylindrical member 119 and annular member 120. Intermediate cavity 140 is defined by a retaining ring 134, diaphragm 114, cylindrical member 119, annular member 120, and carrier film 122. In a preferred embodiment, the retaining ring 134 is coupled to rigid plate 102 using connectors (not shown) that penetrate apertures (not shown) in diaphragm 114.

Retaining ring 134 holds diaphragm 114 tightly against rigid plate 102, even when intermediate cavity 140 is positively or negatively pressurized. In order to permit pressurized fluid (e.g., gas) or vacuum supplied through conduit 110 to reach intermediate cavity 140, an aperture 111 in diaphragm 114 is aligned with fluid conduit 110 and an aperture 113 through retaining ring 134.

As described previously, carrier film 122 is disposed between lower surfaces of members 119, 120 and a semiconductor wafer 124. Carrier film 122 preferably includes one or more apertures 142 to facilitate chucking the wafer 124 using vacuum applied to intermediate cavity 140. Chucking the wafer is described in more detail in conjunction with FIG. 7.

Carrier film 122 is placed in contact with the lower surfaces of annular 120 and cylindrical 119 members, and typically extends in between the two members 119 and 120 across the intermediate cavity 140, though carrier film 122 need not extend across cavity 140. Carrier film 122 preferably comprises DF-200 carrier film manufactured by Rodel Inc. of Newark, Del., though any soft resilient carrier film may be used.

Referring to FIG. 9, it is clear that there is sufficient space around annular clamp 130 to permit application of pressurized fluid (e.g., gas) or vacuum to cavity 104. The same is true for the space around annular clamp 126, permitting application of pressurized fluid (e.g., gas) or vacuum throughout cavity 106.

In a preferred embodiment, carrier 100 is assembled in a particular sequence, although other assembly sequences also could be employed. In a preferred embodiment, members 119 and 120 first are fastened to diaphragm 114. Then, annular clamps 126 and 130 are inserted into their respective cavities 106 and 104. In this regard, retaining lip 129 is keyed to permit insertion of annular clamp 126 into cavity 106. Then, annular clamp 126 is rotated to a position preventing it from falling through the keyed slots (not shown) in retaining lip 129. The retaining ring 134 and wear ring 116 are next fastened to hold the diaphragm 114 in place, as well as to isolate the independent pressurization zones (e.g., three in this case corresponding to cavities 104, 106, and 140) from each other.

FIG. 10 demonstrates that wear ring 116 and retaining lip 129 act as mechanical stops to limit downward motion of annular clamps 126 and 130, and therefore, members 119 and 120. It is assumed that gravitational force pulls members 119 and 120 down to the mechanical stops of clamps 126 and 130. However, when a semiconductor wafer 124 is in place between the carrier 100 and a polishing platen (not shown), the thickness of the wafer 124 tends to prevent clamps 126 and 130 from reaching their mechanical stops. When positive or negative pressures are applied to cavities 104 and 106, clamps 126 and 130 are forced to move toward or away, respectively, from their mechanical stops. In this manner, differential pressures can be applied to the semiconductor wafer 124 via clamps 126, 130 and members 119, 120.

The method of operating carrier 100 is very much analogous to the method described in conjunction with FIG. 7, which referred to operation of carrier 12, The method begins by chucking the semiconductor wafer 124 or other workpiece to be polished. This is achieved by suspending carrier 100 over one or more semiconductor wafers 124 to be processed. Carrier 100 is lowered to a position slightly above the top wafer 124. Conduit 110 is connected to a vacuum source which applies a negative pressure in cavity 140 to chuck semiconductor wafer 124 using apertures 142 in carrier film 122. Positive pressure may also be supplied to cavities 104 and 106 to help maintain a seal with the wafer 124 during chucking.

Next the carrier 100 and wafer 124 are moved over a polishing pad and platen (not shown), and then lowered such that the lower surface of wafer 124 makes contact with the polishing pad. From this point, any polishing technique well known to those skilled in the art may be used, such as rotational, orbital, or a combination thereof. The user may pressurize cavities 104, 106, and 140 to the same pressure in an effort to establish uniform polishing pressure across the entire surface of semiconductor wafer 124. Alternatively, the user may pressurize cavities 104, 106, and 140 to different levels, thereby establishing a non-uniform, yet controlled force distributed across the entire surface of the semiconductor wafer 124.

In this manner, a user can increase the force distribution across an area which would otherwise experience slow removal rates if a uniform force distribution was implemented across the surface of the semiconductor wafer 124. As is clearly illustrated in FIG. 10, this result is made possible by the fact that as one increases the supply pressure in cavity 104, diaphragm 114 expands slightly to cause greater applied force from the annular member 120 against wafer 124. The same is true for pressure supplied to cavity 106, and to a lesser extent to cavity 140. After polishing has been completed, the method ends.

It should be understood that the methods and apparatuses described above are only exemplary and do not limit the scope of the invention, and that various modifications could be made by those skilled in the art that would fall under the scope of the invention. For example, while the pressurized fluid mentioned herein is preferably a pressurized gas, a pressured liquid may be employed in the alternative.

To apprise the public of the scope of this invention, the following claims are provided:

What is claimed:

1. A carrier for an apparatus which performs chemical-mechanical planarization of a surface of a workpiece, wherein the carrier comprises:

a rigid plate having a major surface;

a first diaphragm of soft, flexible material with a first section for contacting a first surface portion of the workpiece, the first diaphragm being connected to the rigid plate and extending across at least a first portion of the major surface thereby defining a first cavity therebetween;

a second diaphragm of soft, flexible material with a second section for contacting a second surface portion of the workpiece, the second diaphragm being connected to the rigid plate and extending across at least a second portion of the major surface thereby defining a second cavity therebetween;

a plurality of fluid conduits by which a source of pressurized fluid is connected to at least one of the cavities; and an inter-diaphragm cavity formed between a portion of the first diaphragm, a portion of the second diaphragm, and a portion of the workpiece.

2. The carrier as recited in claim 1 wherein the first cavity is centered over the first surface portion of the workpiece, which is located on a side of the workpiece that is opposite said surface of the workpiece, and the second cavity is concentrically located with respect to the first cavity.

3. The carrier as recited in claim 1 wherein the first cavity and the second cavity are cylindrical and annular in shape, respectively.

4. The carrier as recited in claim 1 further including an inter-diaphragm cavity formed between a portion of the first diaphragm, a portion of the second diaphragm, and a portion of the workpiece.

5. The carrier as recited in claim 1 further including another fluid conduit by which a source of pressurized fluid is connected to the inter-diaphragm cavity.

6. The carrier head as recited in claim 1 wherein the first diaphragm includes a bellows section located between the diaphragm's connection to the rigid plate and the first section for contacting the first surface portion of the workpiece, said bellows section being adapted to permit expansion of the first cavity substantially along an axis orthogonal to the major surface.

7. The carrier as recited in claim 1 wherein the second diaphragm includes a bellows section located between the second diaphragm's connection to the rigid plate and the second section for contacting the second surface portion of the workpiece, said bellows section being adapted to permit expansion of the second cavity substantially along an axis orthogonal to the major surface.

8. The carrier as recited in claim 1 wherein at least one of the first section of the first diaphragm and the second section of the second diaphragm includes a plurality of apertures therethrough.

9. The carrier as recited in claim 1 wherein the first and second diaphragms are integrally connected to each other.

10. The carrier as recited in claim 1 wherein the soft, flexible material comprises polyurethane.

* * * * *